US012285104B2

(12) United States Patent
Jensen

(10) Patent No.: US 12,285,104 B2
(45) Date of Patent: Apr. 29, 2025

(54) FLOOR TO CEILING WINE RACK POST

(71) Applicant: WINE MASTER CELLARS LLLP, Denver, CO (US)

(72) Inventor: Rachel Jensen, Denver, CO (US)

(73) Assignee: WINE MASTER CELLARS LLLP, Denver, CO (US)

( * ) Notice: Subject to any disclaimer, the term of this patent is extended or adjusted under 35 U.S.C. 154(b) by 0 days.

(21) Appl. No.: 18/218,655

(22) Filed: Jul. 6, 2023

(65) Prior Publication Data

US 2023/0337818 A1 Oct. 26, 2023

Related U.S. Application Data

(63) Continuation of application No. 17/156,001, filed on Jan. 22, 2021, now Pat. No. 11,723,458.

(60) Provisional application No. 62/964,380, filed on Jan. 22, 2020.

(51) Int. Cl.
*A47B 73/00* (2006.01)
*A47B 47/00* (2006.01)

(52) U.S. Cl.
CPC ..... *A47B 73/00* (2013.01); *A47B 47/00* (2013.01)

(58) Field of Classification Search
CPC ..... A47B 73/00; A47B 73/006; A47B 47/00; A47B 47/022
USPC ..... 211/107, 205
See application file for complete search history.

(56) References Cited

U.S. PATENT DOCUMENTS 2,941,669 A * 6/1960 Palay ..... A47F 5/025 211/163
3,003,646 A * 10/1961 Wolf ..... A47F 5/04 29/897
3,018,898 A * 1/1962 Frazelle ..... F16M 11/046 248/220.43
3,035,708 A * 5/1962 Freeman ..... A47B 96/1425 108/147.19
3,221,678 A * 12/1965 Doherty ..... A47B 57/26 108/106
3,593,857 A * 7/1971 Hernes ..... A47F 11/02 428/101
3,828,937 A * 8/1974 Nash ..... A47B 57/14 248/200.1
4,453,640 A * 6/1984 Cillario ..... A47F 5/04 211/133.4
4,819,817 A * 4/1989 Mar ..... A47B 96/1425 446/268
5,284,260 A * 2/1994 Caligiuri, Sr. ..... A47B 96/1425 211/107
5,318,175 A * 6/1994 Stevens ..... A47G 25/0664 211/205
5,343,816 A * 9/1994 Sideris ..... A47B 63/062 211/144
5,458,243 A * 10/1995 McBride ..... A47B 87/0261 211/196

(Continued)

FOREIGN PATENT DOCUMENTS

DE 202018106151 U1 * 1/2019 ..... A47B 73/00
FR 2632503 A1 * 12/1989
GB 2407970 A * 5/2005 ..... A47B 73/006

*Primary Examiner* — Stanton L Krycinski
(74) *Attorney, Agent, or Firm* — Polsinelli PC

(57) ABSTRACT

A floor to ceiling wine rack post that is capable of holding multiple wine bottles in a substantially parallel manner, i.e., the label of the first wine bottle is visible to a person standing in front of the wine rack.

10 Claims, 33 Drawing Sheets

(56) References Cited

U.S. PATENT DOCUMENTS 5,517,928 A * 5/1996 Erdman ..... A47B 87/0207 403/375
5,797,501 A * 8/1998 Von Gunten ..... A47B 57/42 211/183
5,918,432 A * 7/1999 Mahone ..... A47B 47/00 52/36.5
5,931,315 A * 8/1999 Lorentz ..... G11B 33/0483 211/205
6,065,618 A * 5/2000 Stetler ..... A47G 25/0664 211/205
6,494,327 B2 * 12/2002 Huang ..... B62H 3/12 211/205
6,644,609 B1 * 11/2003 Scott ..... A47B 96/1458 248/909
6,688,238 B1 * 2/2004 Alexiou ..... A47K 3/281 108/42
6,983,853 B1 * 1/2006 Fickett ..... A47F 7/00 248/303
6,991,117 B2 * 1/2006 McCain ..... A47B 73/00 211/75
D569,148 S * 5/2008 Yang ..... D6/525
D573,387 S * 7/2008 Walker ..... D6/525
7,878,340 B1 * 2/2011 Olsen ..... A47B 73/00 211/186
7,882,967 B2 * 2/2011 Hynes ..... A47B 73/00 211/75
8,240,488 B2 * 8/2012 Huang ..... B05B 13/0292 211/107
8,348,072 B2 * 1/2013 Whitehall ..... A47F 5/04 248/408
8,408,405 B2 * 4/2013 Yang ..... A47K 5/04 248/235
8,720,704 B2 * 5/2014 Gupta ..... A47B 96/025 211/74
8,820,543 B2 * 9/2014 Huang ..... F16B 2/246 248/230.4
9,078,516 B2 * 7/2015 Vogel ..... A47B 73/00
9,326,601 B2 * 5/2016 Gupta ..... A47B 57/42
10,729,226 B1 * 8/2020 Zamora ..... A45F 3/44
D899,827 S * 10/2020 Louden ..... D6/681.1
2006/0186073 A1 * 8/2006 Roe ..... D06F 59/02 211/85.3
2012/0085721 A1 * 4/2012 Michael J ..... A47F 5/0853 211/103
2014/0339182 A1 * 11/2014 Koder ..... A47F 7/283 211/74
2015/0034577 A1 * 2/2015 Cash ..... A47B 49/00 211/74
2015/0157124 A1 * 6/2015 Cipolla ..... A47F 7/0035 211/186
2016/0007743 A1 * 1/2016 Koder ..... A47B 73/002 211/74

* cited by examiner

FLOOR TO CEILING WINE RACK POST

RELATED APPLICATIONS

The present application is a continuation of application Ser. No. 17/156,001 filed Jan. 22, 2021, which application claims the benefit of U.S. Provisional Patent Application 62/964,380 filed Jan. 22, 2020. Each of the above-referenced applications is incorporated herein by reference in their entirety.

FIELD OF THE INVENTION

The present invention relates in general to racks for storing and/or displaying wine bottles, and more specifically, to modular wine racks.

BACKGROUND

Typically, wine bottles are placed in storage racks that are attached directly to a wall, as disclosed, for example in U.S. Pat. No. 6,991,117, wherein a wine rack for mounting to a wall is described. Moreover, typical wine racks, like the one described in U.S. Pat. No. 6,991,117, can be easily sold in set configurations, for example, in lengths of 3, 4 and 6 feet, and capable of holding bottles one, two or three-deep. As a consequence, the user of rack is able to acquire the pre-configured wine racks and easily install the wine racks themselves, thereby avoiding the extra cost associated with customizing racks and hiring installers.

Wine racks are used in many contexts. They are used in personal residences in living areas of the home, such as kitchens and great rooms, as well as dedicated wine cellars and closets. They are also used by businesses, such as restaurants, which need to store many bottles of wine both in public and private areas of the business.

However, in many contexts, a physical wall upon which a typical wine rack is attached may not be available. For example, many kitchens and great rooms are located in open areas of the residences wherein minimal wall space is available to display the wines held by the wine rack. Similarly, many restaurants are in open areas where again minimal wall space is available to display the wines held by the wine rack.

Known floor to ceiling racks for holding wine bottles are limited because standard lengths often do not fit the intended vertical spaces, and often require customization by the manufacturer/installer to fit the intended space. As such, there is a need in the industry for a floor to ceiling wine post that addresses the limitations of the prior art, which provides the user the ability to acquire posts that the user can easily accommodate to the user's desires and spaces, and thereby avoid the costs and time associated with customization and hiring installers.

SUMMARY OF THE INVENTION

The wine rack post of the present invention provides a versatile floor-to-ceiling framing system to create floating wine racks by taking typical wall-mounted systems off the wall and creating the ability to design room dividers and unique decor enhancements in residential and commercial environments, including wine cellars.

The wine rack post of the present invention is a design-focused utility product that is the perfect tool for users when wall space is at a premium or user's plans call for wine to be stored in the middle of a room. Furthermore, the wine rack post of the present invention works with virtually all known wine racking systems, to provide maximum flexibility and look.

The present invention's floor to ceiling wine post is designed to attach to an upper support structure, such as ceiling, and a lower support structure, such as a floor, which serves to hold the wine post in a vertical orientation. It will be appreciated that there are numerous known ways that the post can be attached to the upper support structure (i.e., a ceiling) and/or the lower support structure (i.e., the floor). It will be further appreciated that there are numerous known attachment mechanisms can also be used to attach the post of the present invention to a wall in place or in addition to attaching the post of the present invention to the upper support structure (i.e., a ceiling) and/or the lower support structure (i.e., the floor).

The present invention's floor to ceiling wine post is designed in a manner to minimize the support structure for the wine rack and give the illusion of floating wine bottles, especially when installed away from a wall. Since the post of the present invention is attached the upper support structure (i.e., a ceiling) and/or the lower support structure (i.e., the floor), it should be appreciated that the post of the present invention does not require a wall to be installed, although it can be installed close to a wall. In this regard, the post of the present invention may be installed at any position in a room, including interior areas of the room, away from any wall structures. Moreover, the post of the present invention can be used to form a "wine wall" in the interior of the room, away from any physical walls. Importantly, when a post of the present invention is installed, wine racks are attached to the post and wine bottles are placed in the rack, the post itself blends into the background, and thereby gives the illusion the bottles of wine held by the rack are "floating."

As will be appreciated, rooms wherein the present invention will be installed may vary widely in height. The present invention's floor to ceiling wine post is further designed to easily allow the user to adjust the height of the post to accommodate an endless number of possible height requirements, and thereby avoid the additional costs of customization and hiring an installer. The present invention post can be pre-configured in fix lengths and adjusted by the user to various heights, and thus avoid expenses and time associated with customization and installation.

The present invention is constructed in a way that allows for wine bottle support arms of differing orientations dependent on user requirements to be connected to post, and there are a variety of support arms commercially available that will work with the present invention. Specifically, for example, the present invention can be used with pins or racks. Further, the support arms can be configured one, two, three and/or four sides of the post.

The present invention system allows for a large number of shapes and bottle support configurations. Finally, multiple posts in accordance with the present invention can be oriented together to create room dividers or "wine walls."

DETAILED DESCRIPTION

Figure 2:
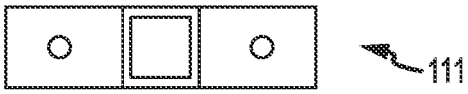
FIG. 2 is a base view of base plate 111 of the post 10 of the present invention.
Figure 3:
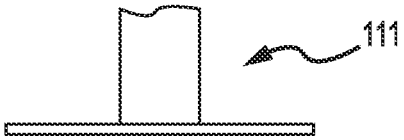
FIG. 3 is a base elevation view of the base plate 111 of the post 10 of the present invention.
Figure 1:
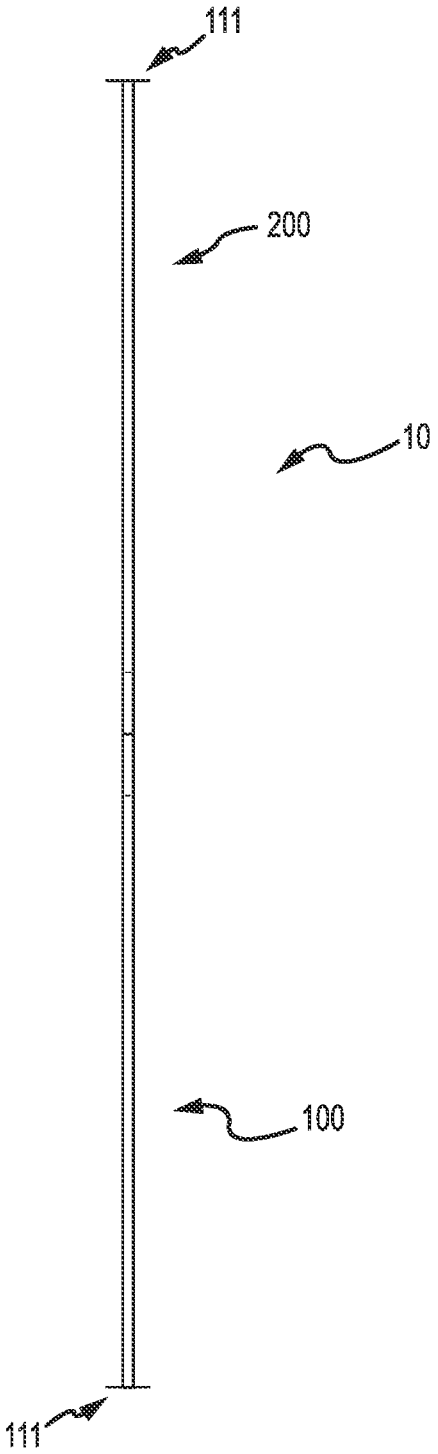
FIG. 1 is a full elevation view of the post 10 of the present invention.
Figure 4:
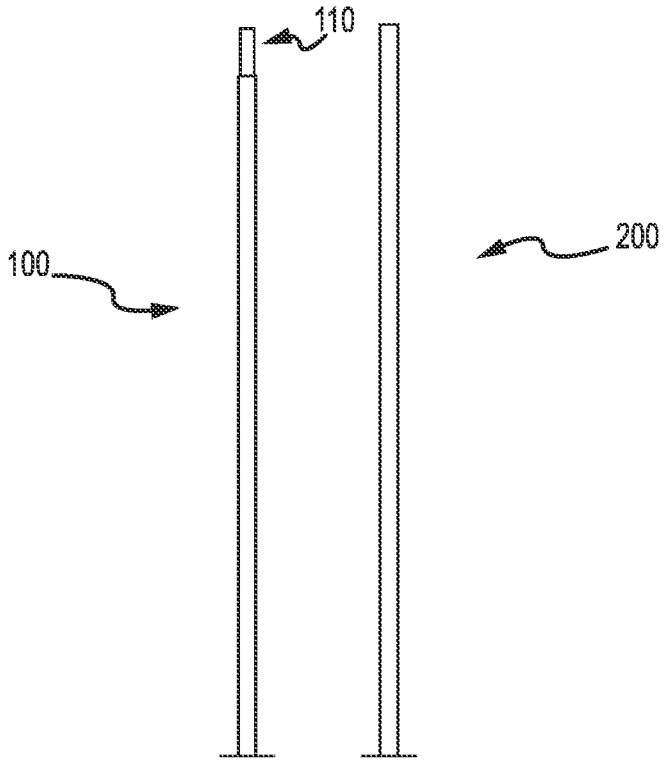
FIG. 4 is an elevation view of the post base 100 and post top 200 of the post 10 of the present invention.
Figure 5:
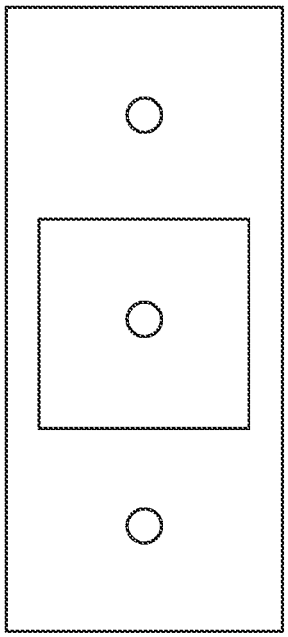
FIG. 5 is a base view of base plate 111 of the post 10 of the present invention.
Figure 6:
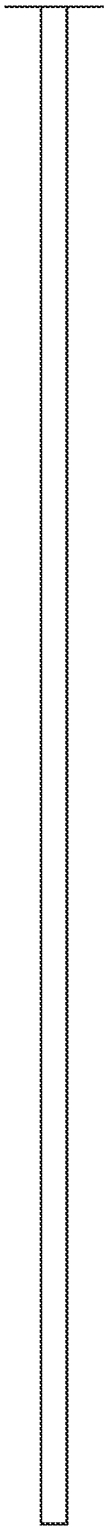
FIG. 6 is an elevation view of the post top 200 of the post 10 of the present invention.
Figure 7:
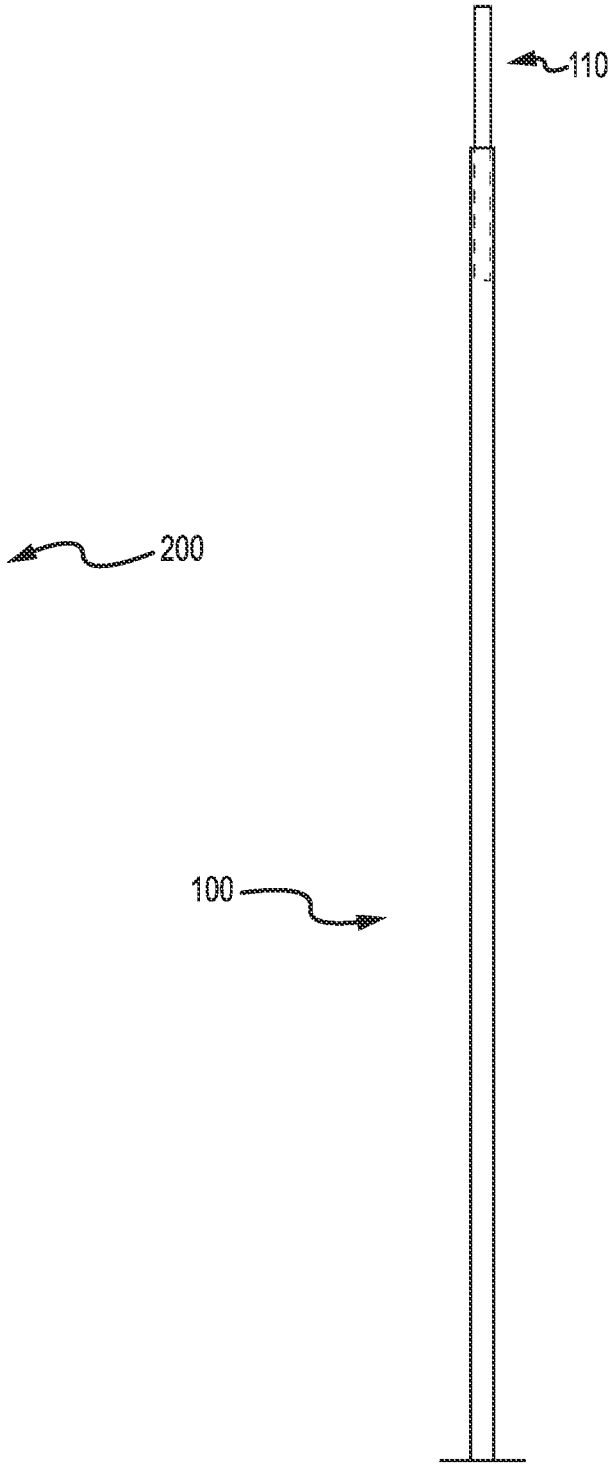
FIG. 7 is an elevation view of the post base 100 of the post 10 of the present invention.
Figure 8A:
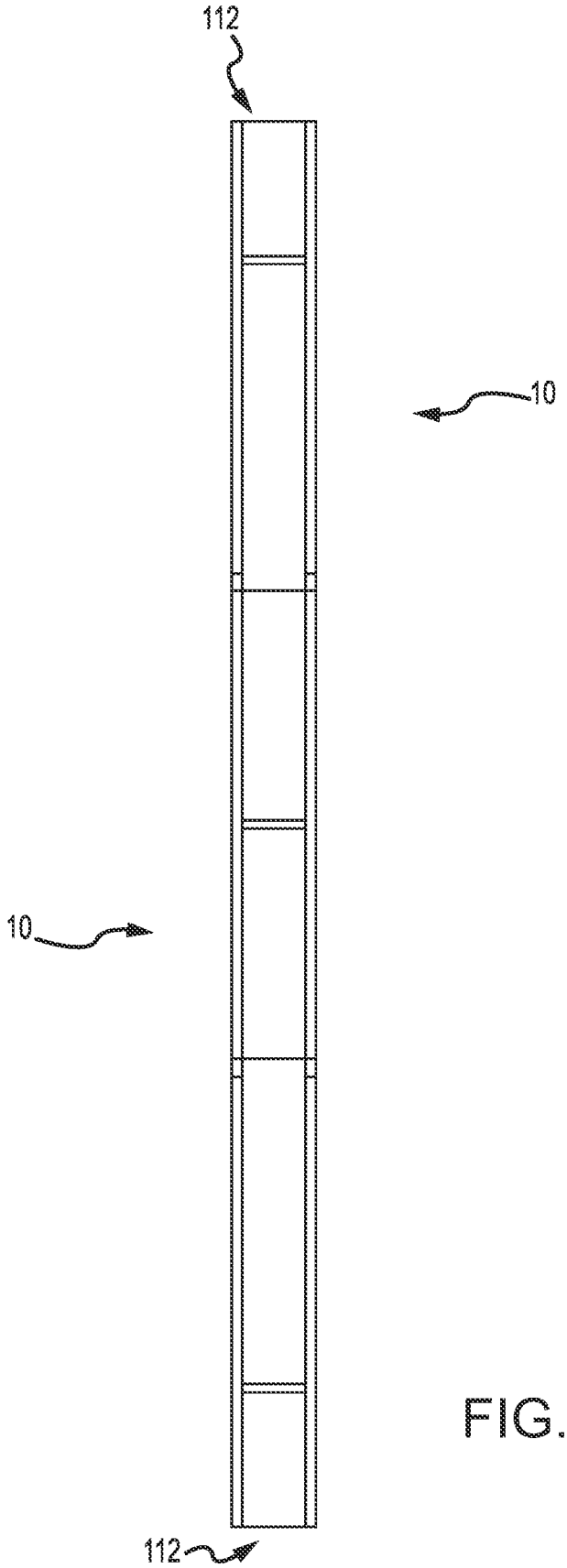
FIGS. 8A-8D show various views of two posts 10 used together, an alternative embodiment of the present invention.
Figure 8B:
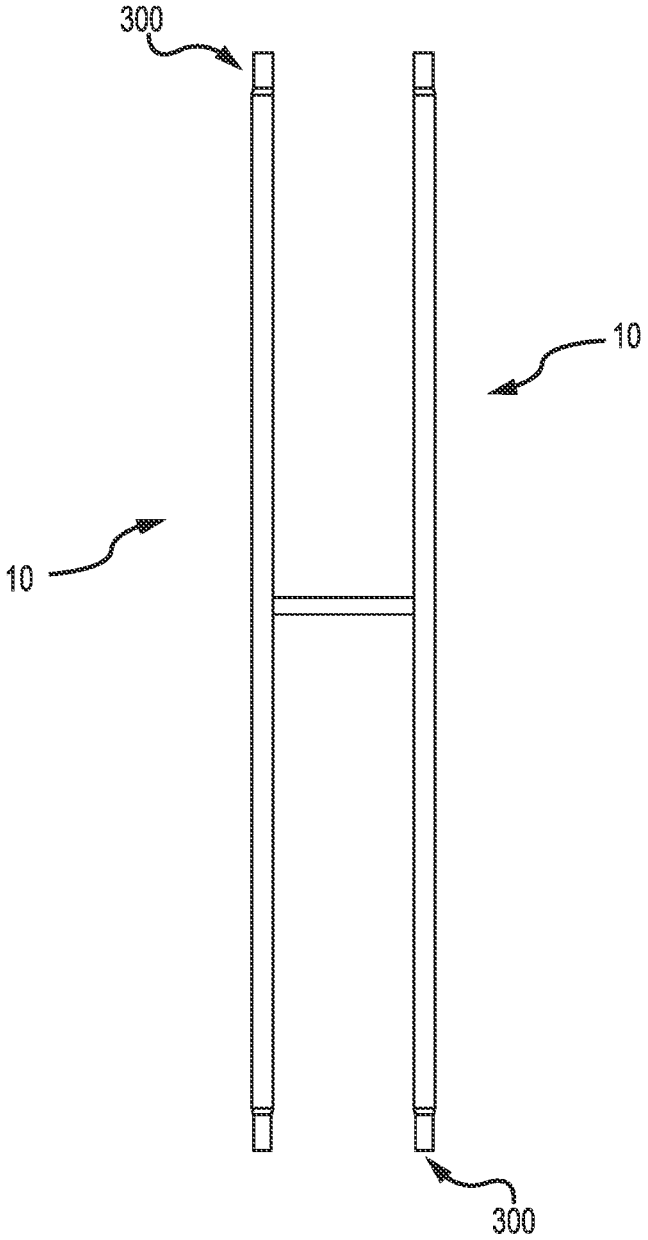
Figure 8C:
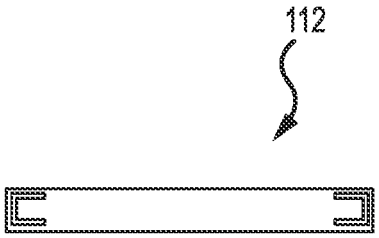
Figure 8D:
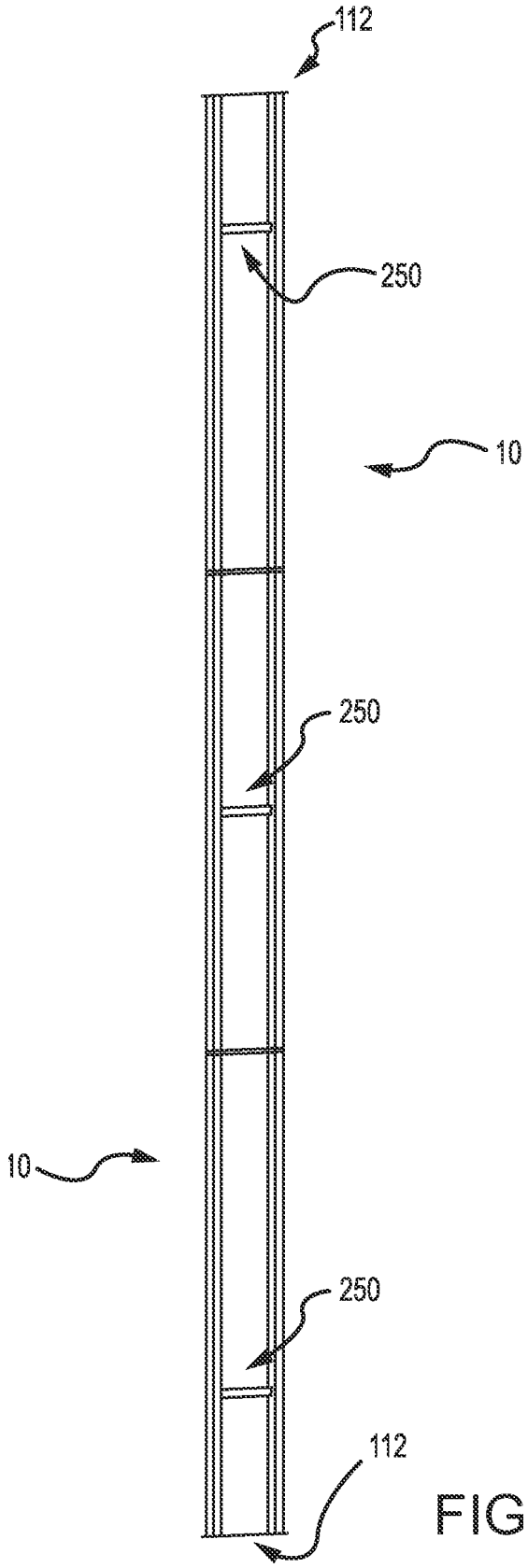

The present invention is floor to ceiling wine post mounted to an upper surface, such as for example a ceiling or counter, and a lower surface, such as for example a floor, and configured to vertically secure one or more support arms to hold wine bottles.

With reference to the FIGS. 1-7, a wine bottle storage post 10 is shown. The post 10 comprises two parts, a post base 100 that comprises on one end a C-channel end 110 and a base plate 111 on the opposite end, and a post top 200 that has on one end mates with the C-channel end 110 and a base plate 111 on the opposite end. When the post base 100 is mated with the post top 200, the resulting post 10 comprises a smooth post with only one seem that is well hidden. The post base 100 and post top 200 preferably are manufactured in predetermined lengths such as, for example, lengths of 3 feet, 4 feet, 5 feet and 6 feet. It will also be appreciated that the post base 100 and post top 200 need not be manufactured in identical lengths. It will also be appreciated that base plates 111 may be removably connected with the post base 100 and/or post top 200.

With reference to FIGS. 8A-8D, one embodiment of the invention with two posts 10 is shown. This particular embodiment is designed for higher than typical ceiling heights, for example 12 feet or higher, to provide additional support to the posts to allow wine racks to be attached to the posts and wine bottles in the rack. This embodiment further comprises support members 250. Additionally, this embodiment further comprises ends 300 which are C-channels that are mated to the base plates 112.

Figure 9A:
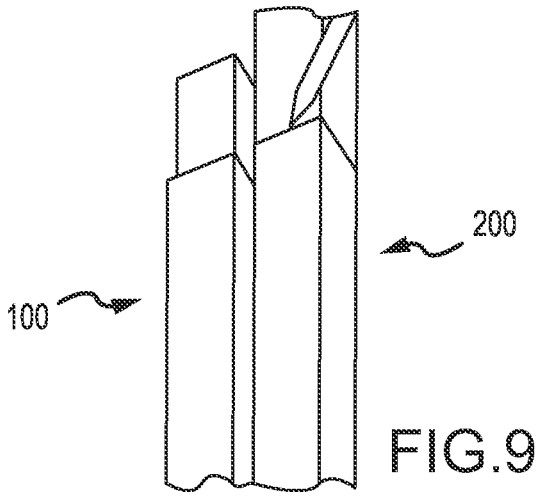
FIGS. 9A-9E show perspective views post base 100 and post top 200 of the post 10 of the present invention.
Figure 9B:
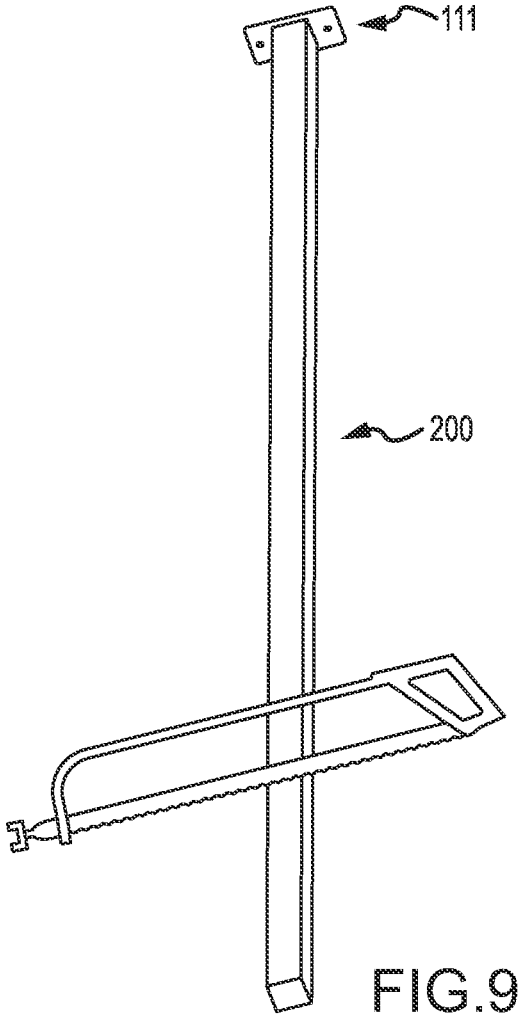

It will be appreciated that the post top 200 may be cut by the user to allow the post base 100 and post top 200—when mated together—to fit the user's floor to ceiling space. In this regard, a user first measures the ceiling height in the place where the post 10 is to be installed. Next, the user lays the post base 100 and the post top 200, interlaced as shown in FIG. 9A, positioning post base 100 and post top 200 so that the measurement from the top to bottom of the base plates 111 equals the user's ceiling height and the user marks the post 200. Using a reciprocating saw, band saw, or hack saw, the user squarely cuts the post top 200 at the mark made by the user as shown in FIG. 9B.

The post 10 of the present invention is assembled by sliding the post base 100 and the post top 200 together. The post of the present invention is installed by standing up the post 10 in the desired location, ensuring that the post 10 is plumb both front and back and side-to-side using a level, and attaching the respective mounting plates 111 of the post 10 to the ceiling and floor. Installing the post 10 simply requires tools readily available, including a Phillips head driver or drill, level, pencil, tape measure, metal cutting saw and metal file. Each mounting plate 111 is pre-drilled for installing to the ceiling or floor using known fasteners. The post base 100 and the post top 200 may be secured by known fastening mechanisms or it will be appreciated that the post 10 becomes secure when the respective base plates 111 are attached to the floor and ceiling.

Figure 9C:
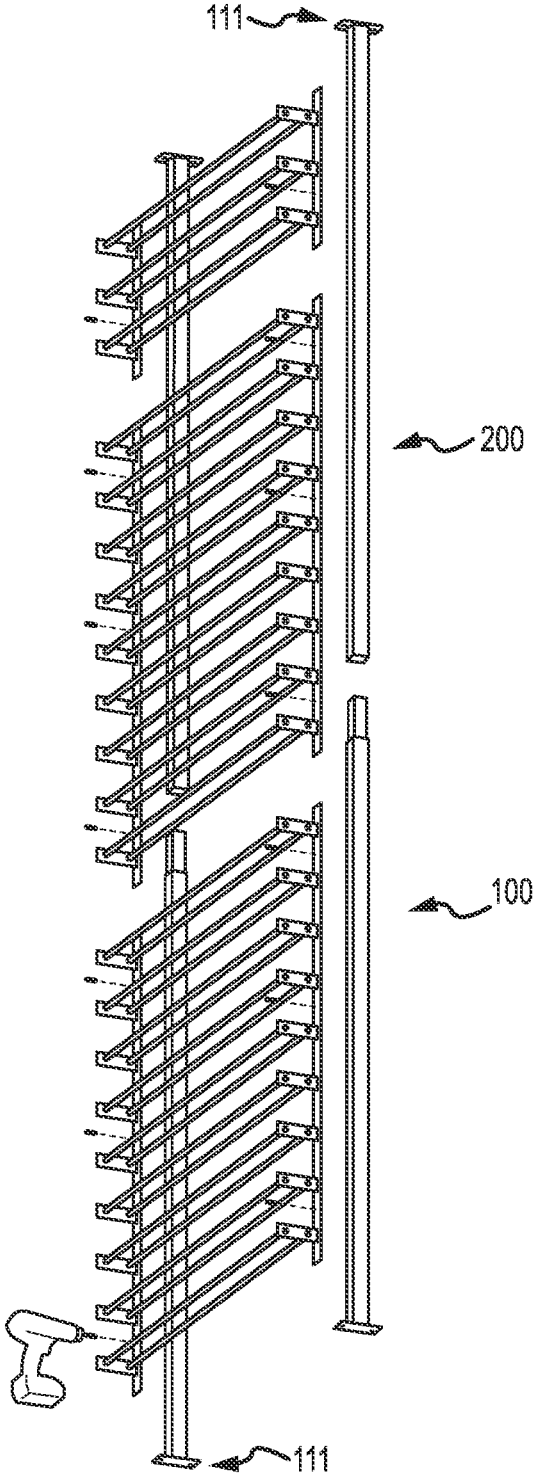
Figure 9D:
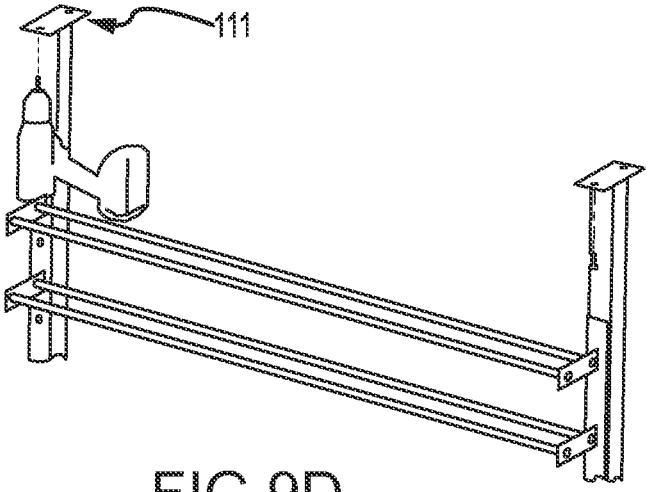
Figure 9E:
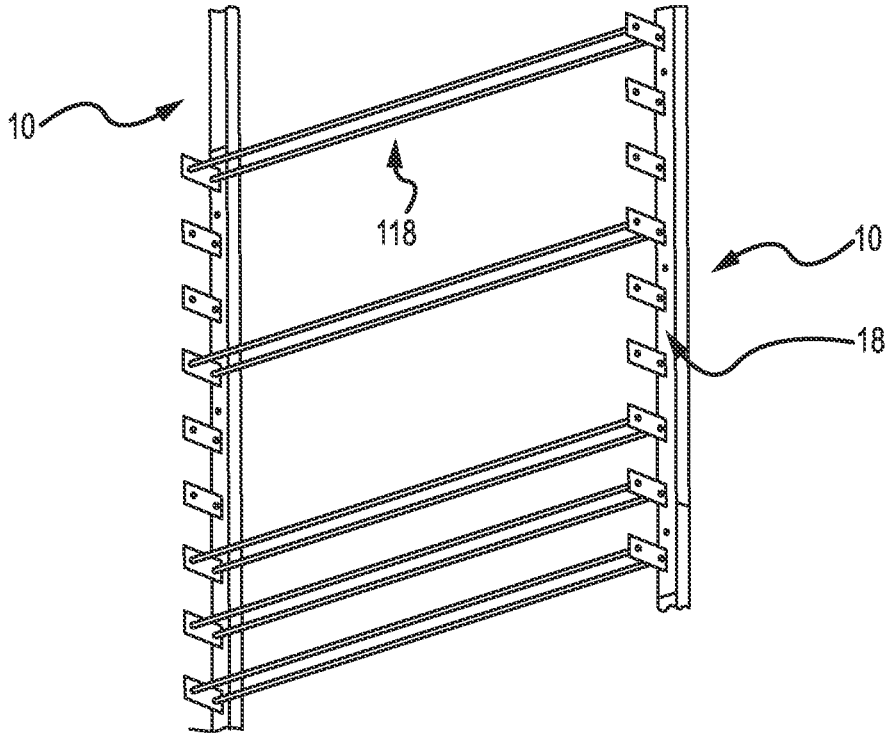
Figure 10A:
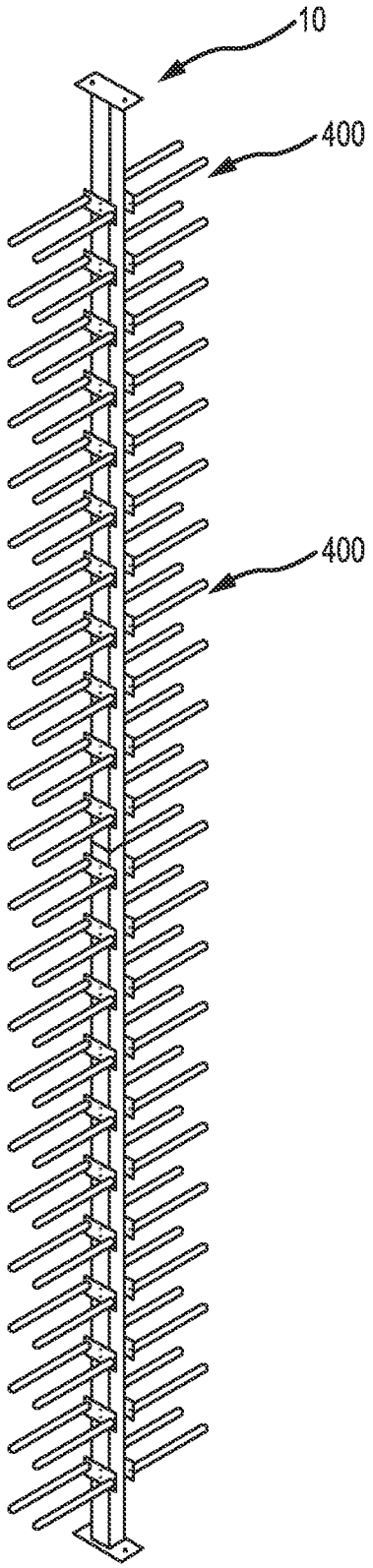
FIGS. 10A-10D show a perspective, front, side and top views of an embodiment of the present invention with the post 10 and wine racks 400 attached to the post 10.
Figure 10B:
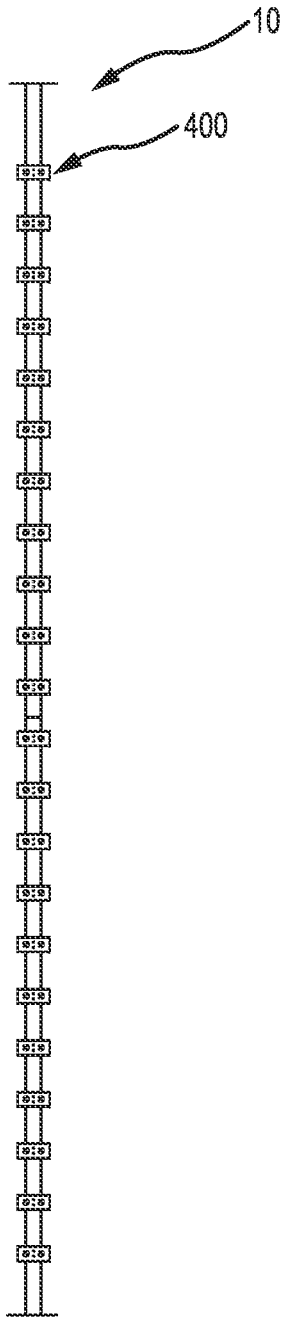
Figure 10C:
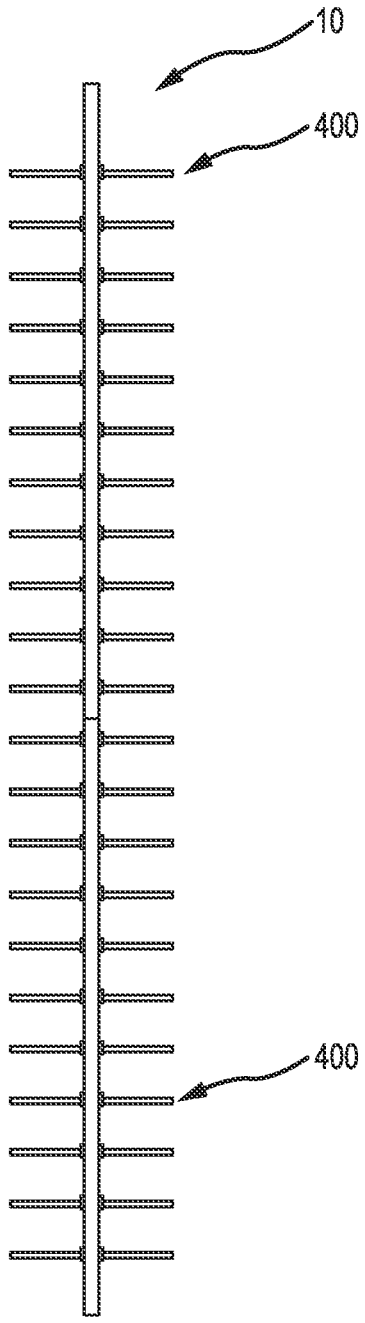
Figure 10D:
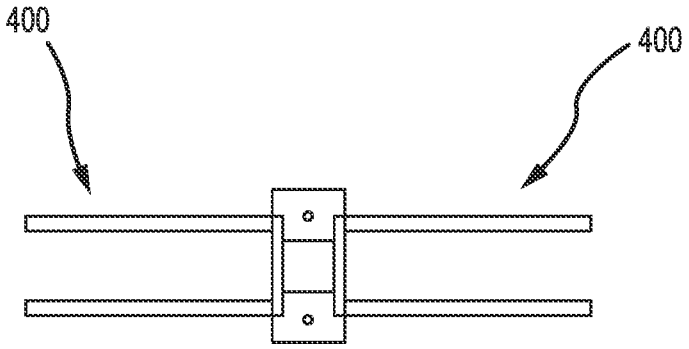
Figure 11A:
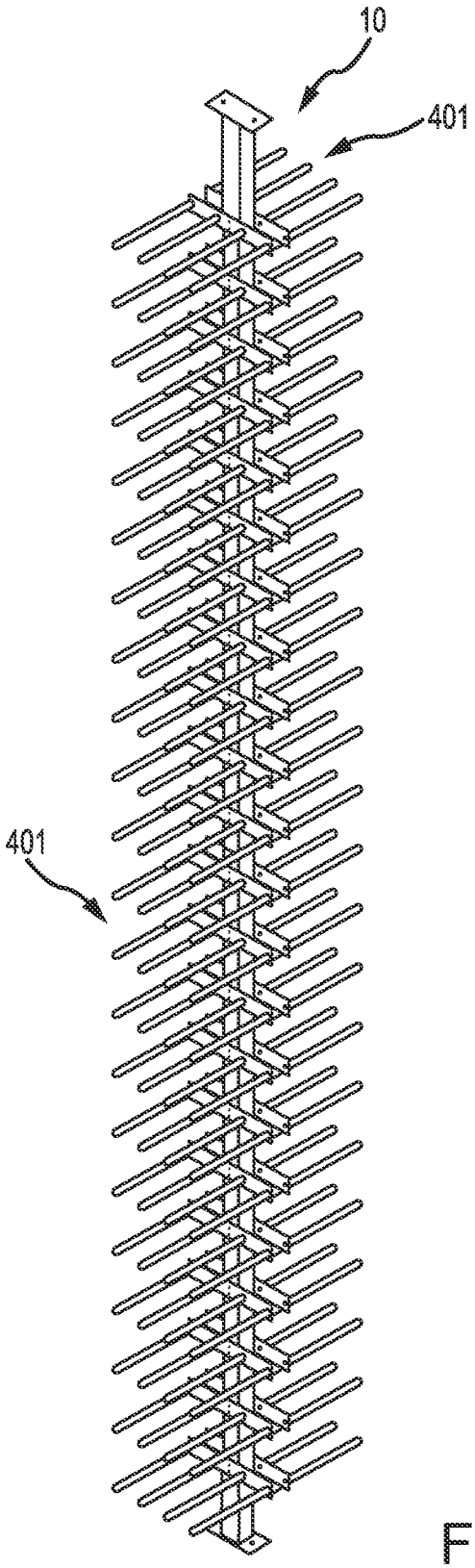
FIGS. 11A-11D show a perspective, front, side and top views of an embodiment of the present invention with the post 10 and wine racks 401 attached to the post 10.
Figure 11B:
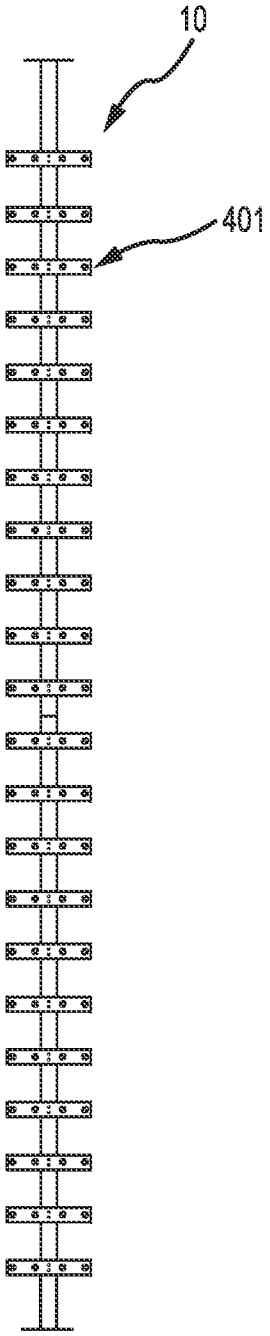
Figure 11C:
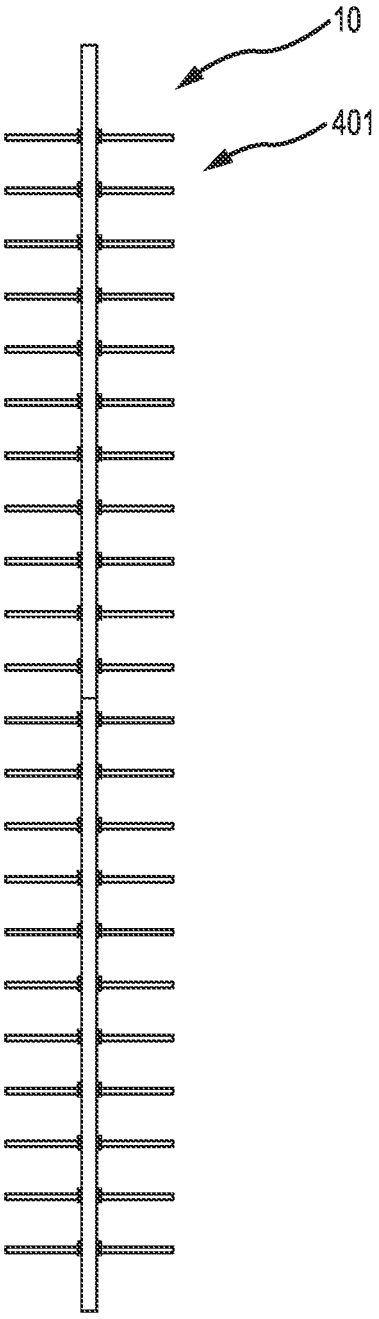
Figure 11D:
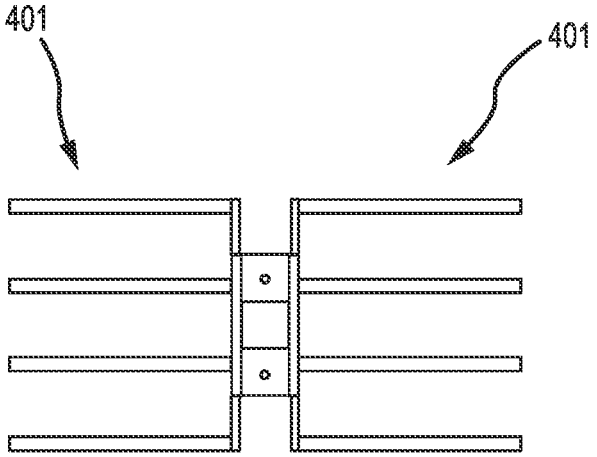
Figure 12A:
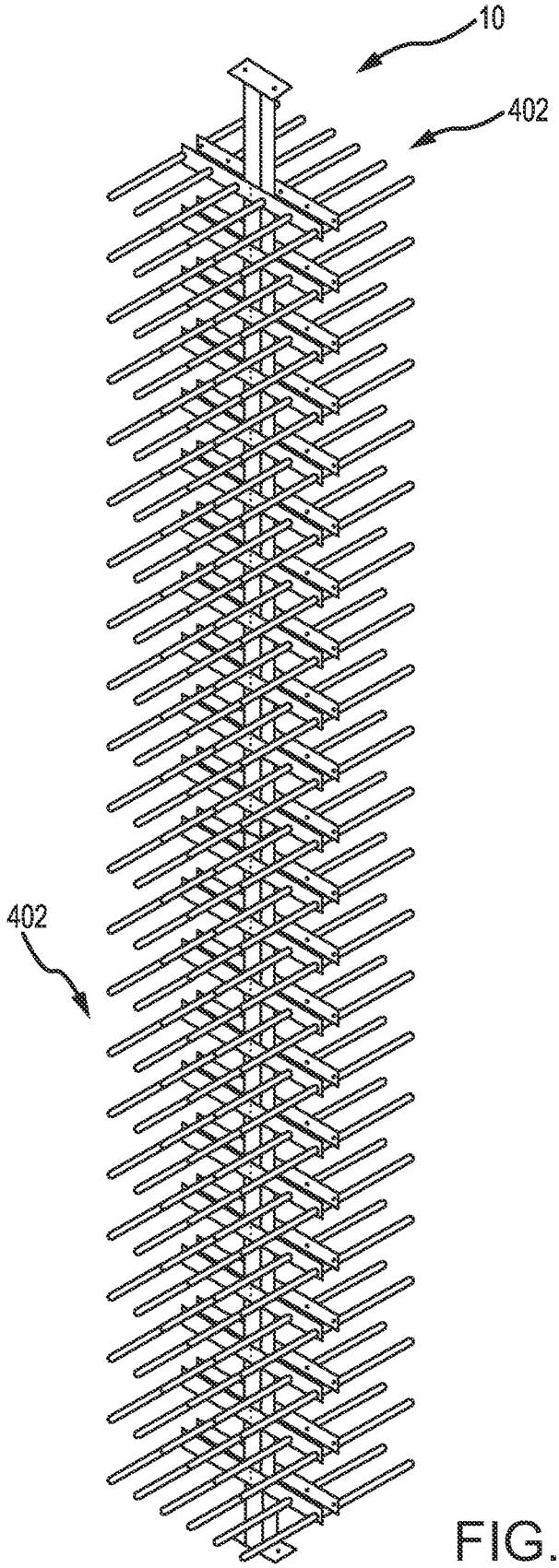
FIGS. 12A-12D show a perspective, front, side and top views of an embodiment of the present invention with the post 10 and wine racks 402 attached to the post 10.
Figure 12B:
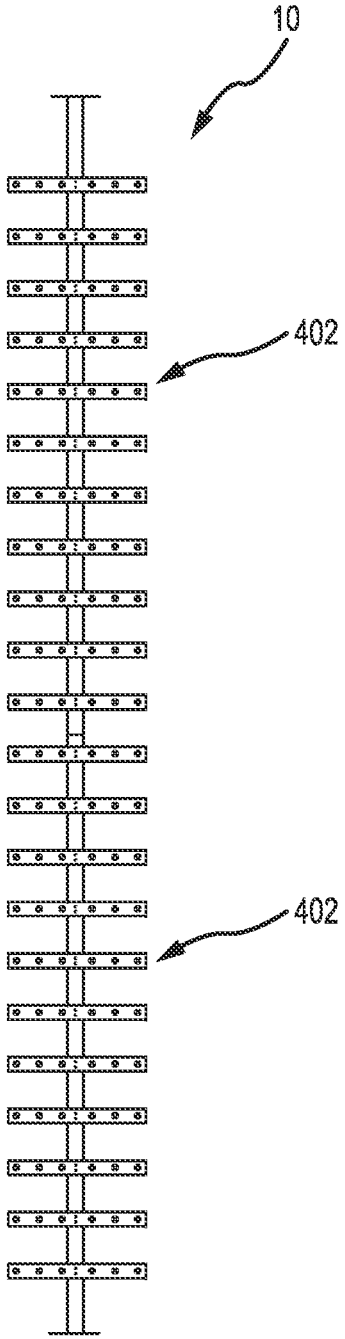
Figure 12C:
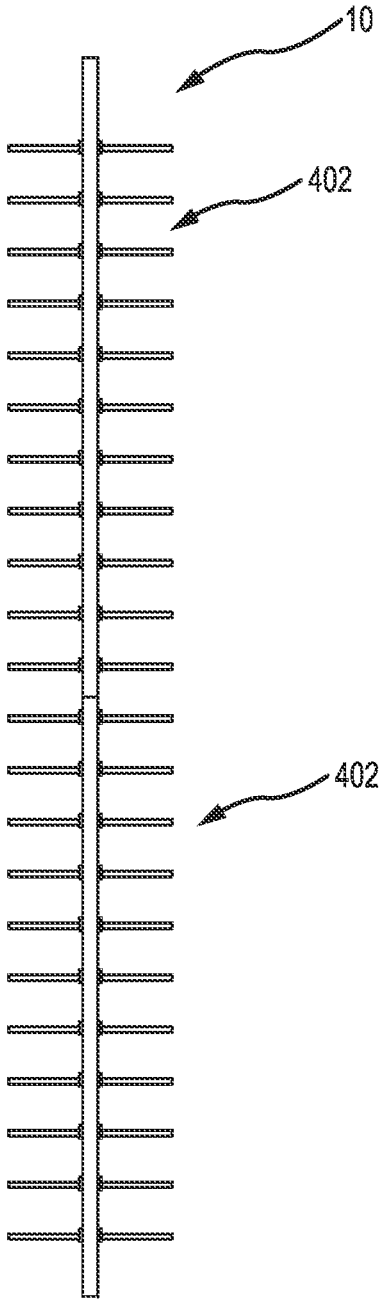
Figure 12D:
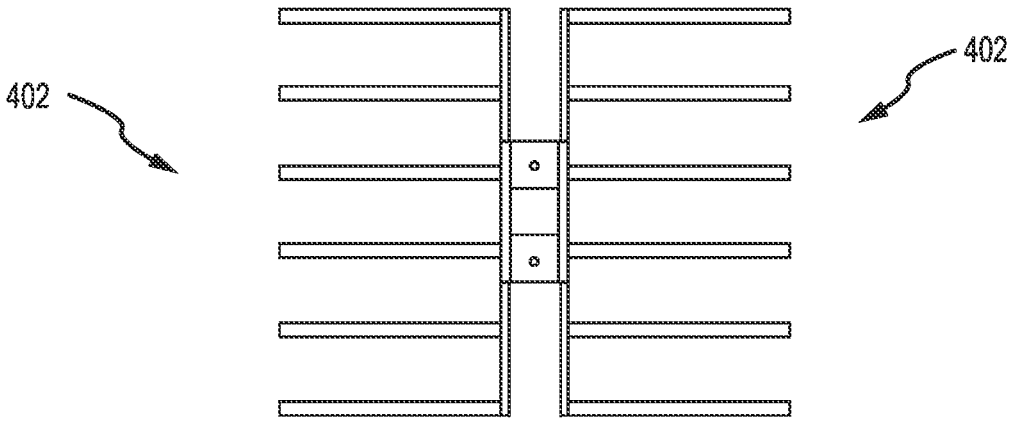
Figure 13A:
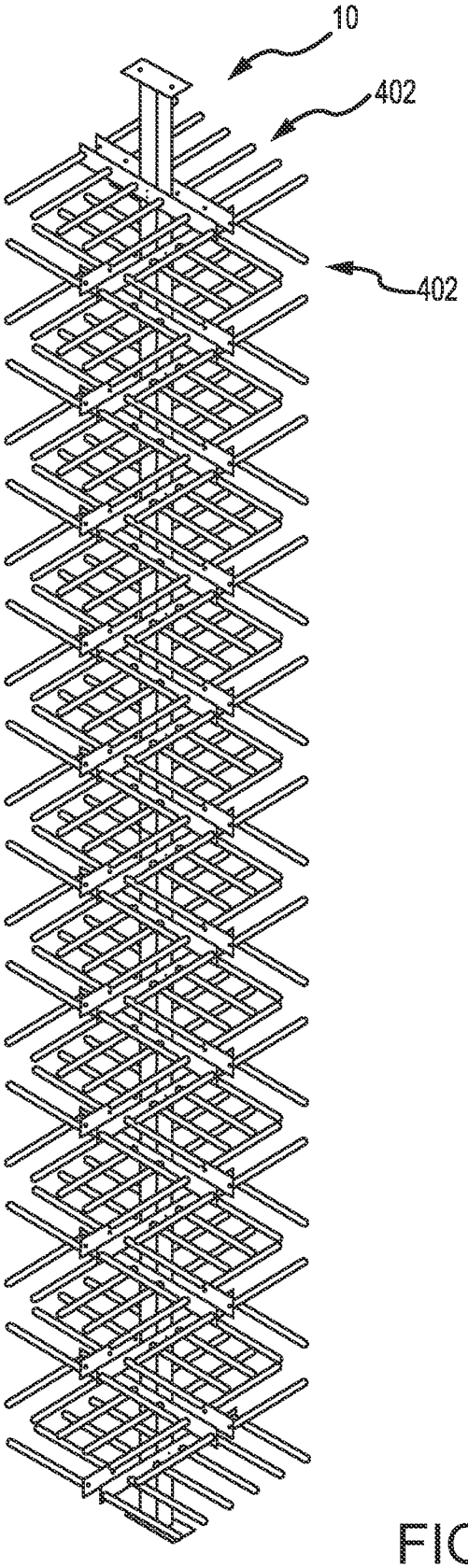
FIGS. 13A-13D show a perspective, front, side and top views of an embodiment of the present invention with the post 10 and wine racks 402 attached to the post 10 alternating at each level.
Figure 13B:
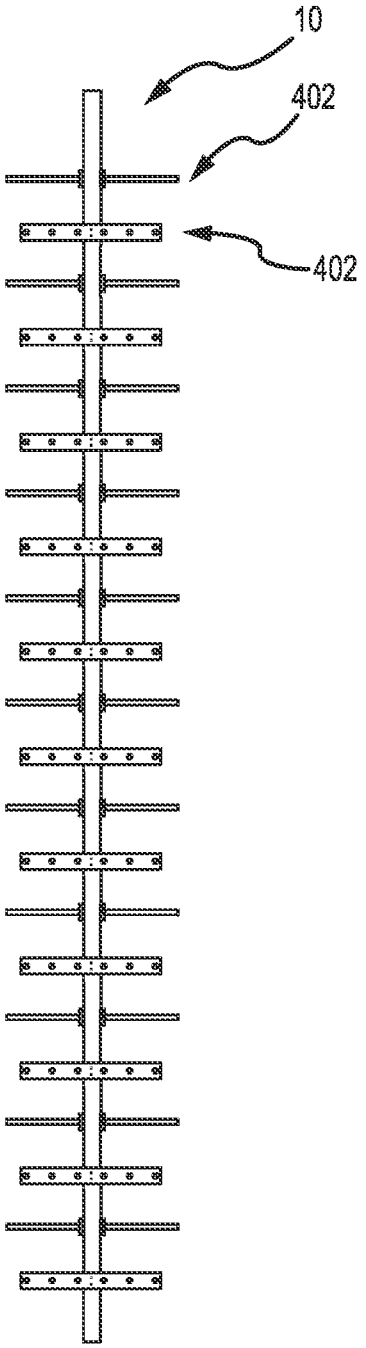
Figure 13C:
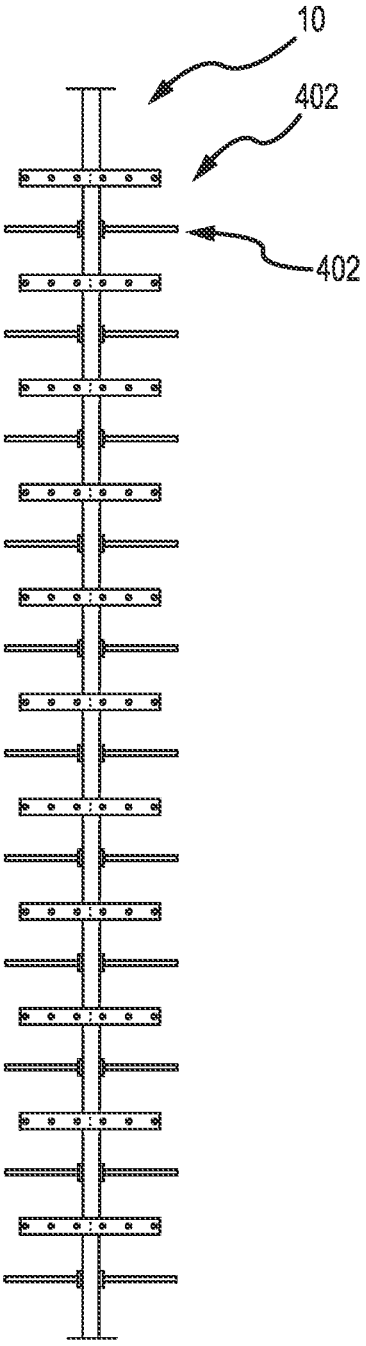
Figure 13D:
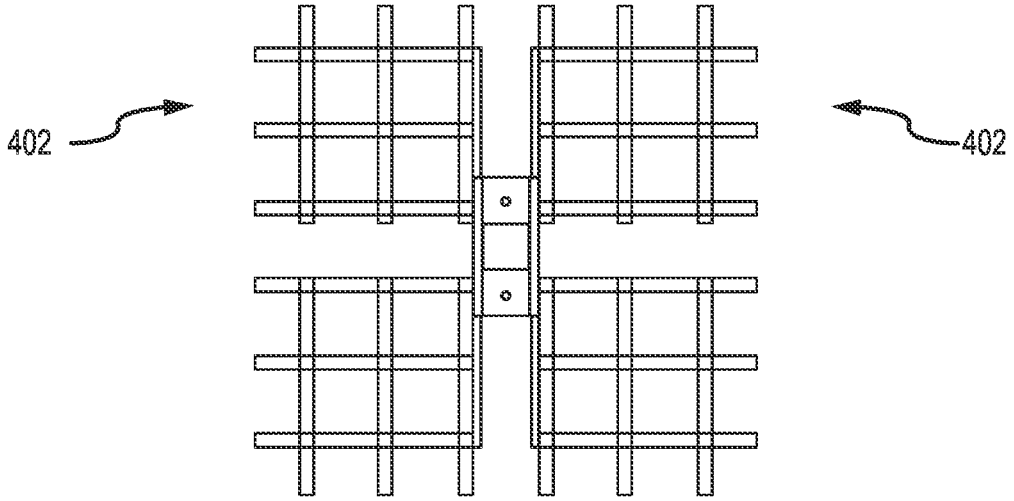
Figure 14A:
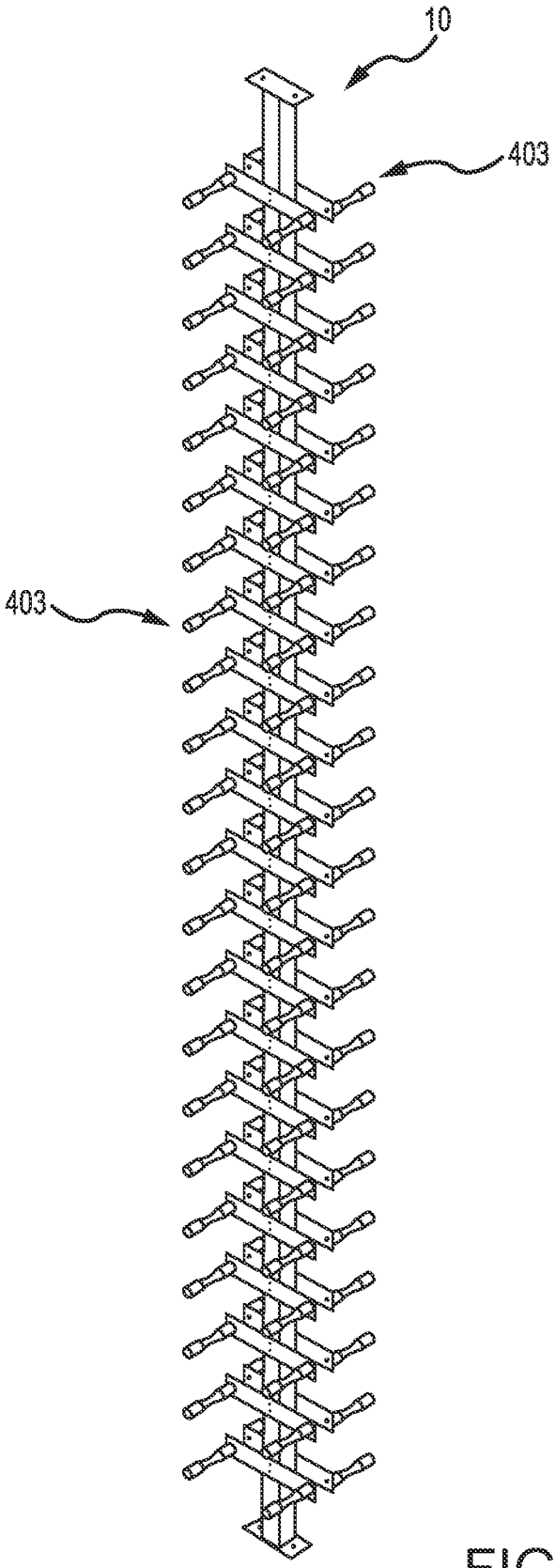
FIGS. 14A-14D show a perspective, front, side and top views of an embodiment of the present invention with the post 10 and wine racks 403 attached to the post 10.
Figure 14B:
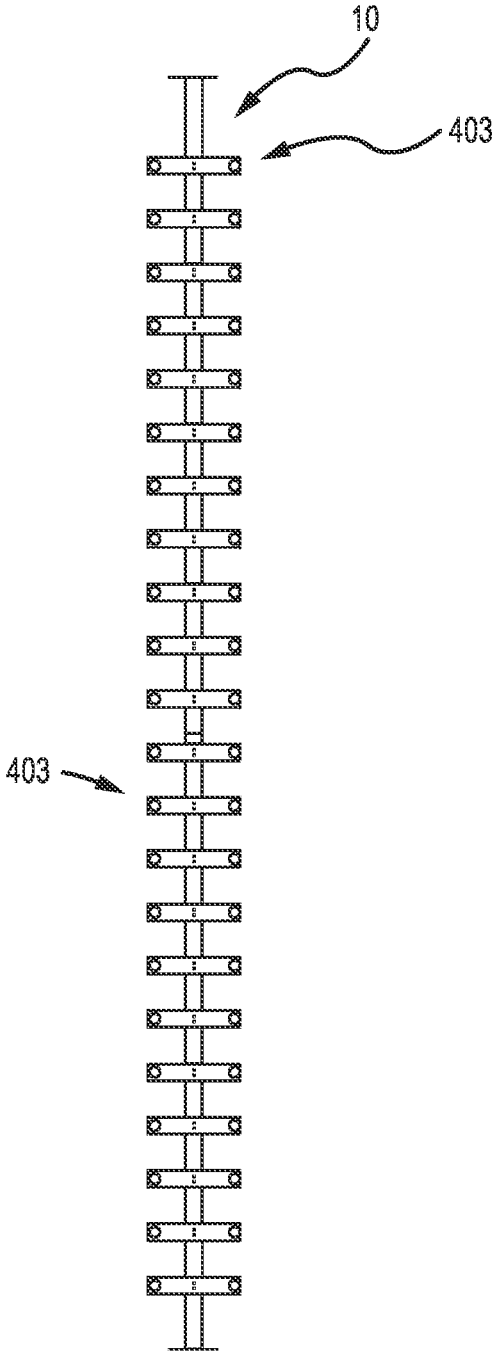
Figure 14C:
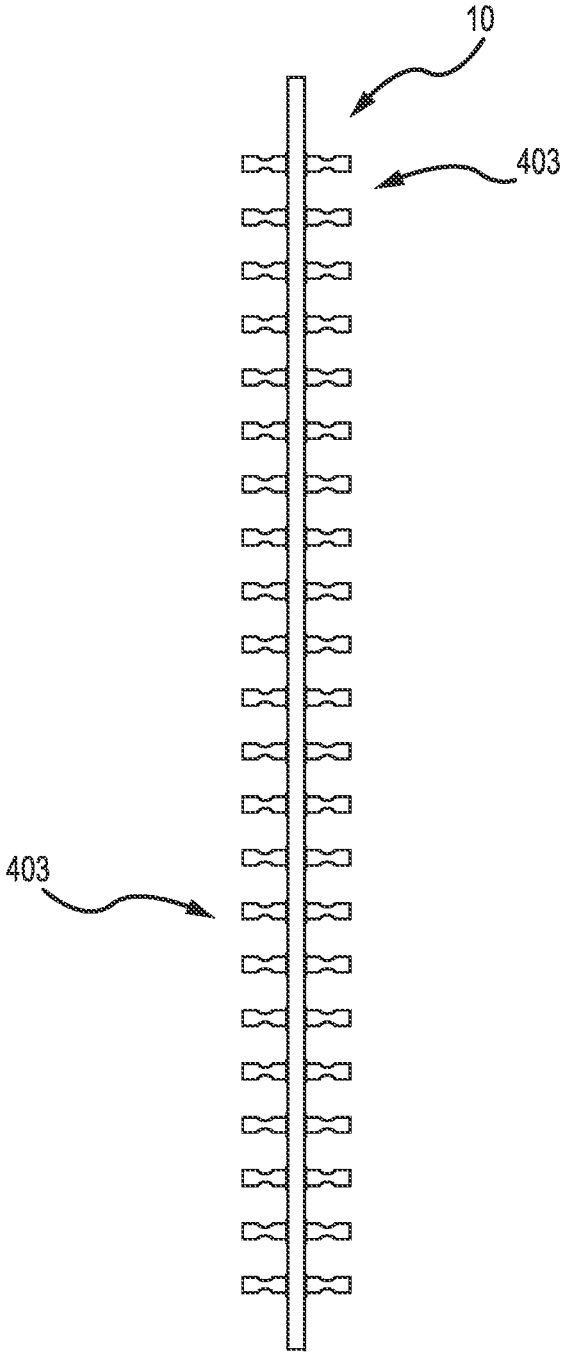
Figure 14D:
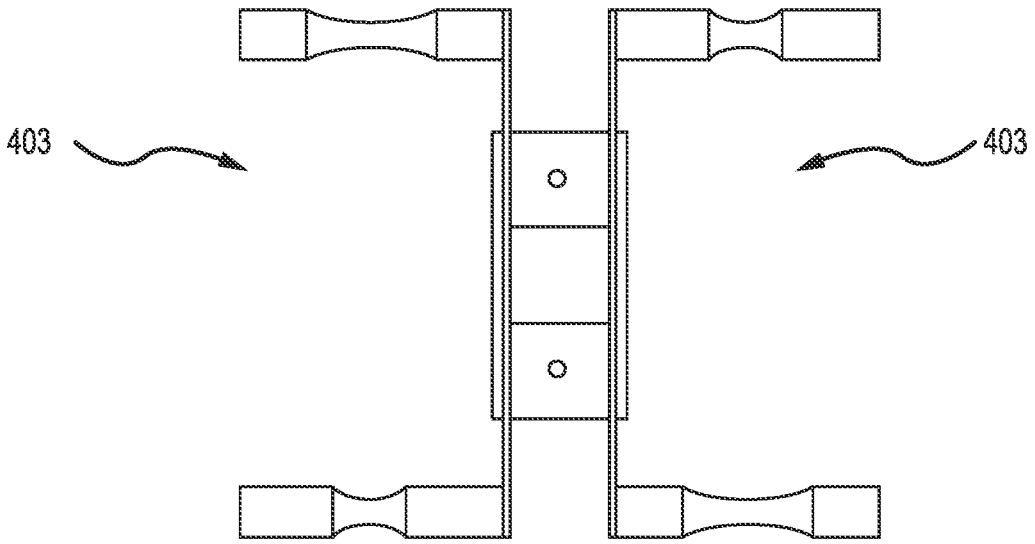
Figure 15A:
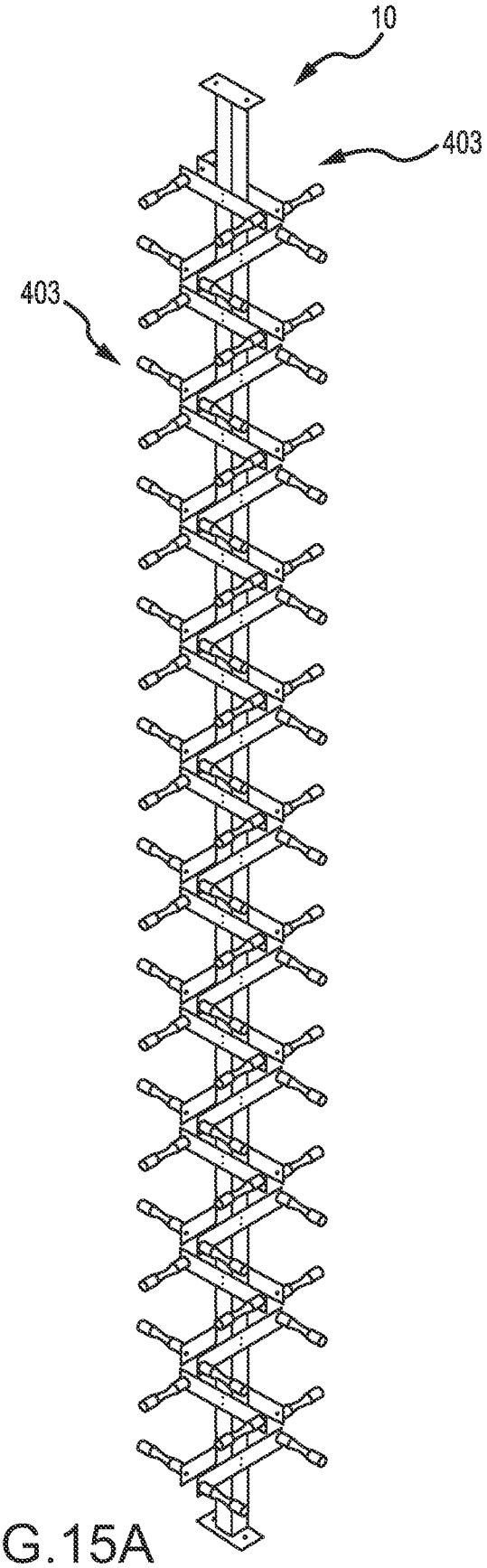
FIGS. 15A-15D show a perspective, front, side and top views of an embodiment of the present invention with the post 10 and wine racks 403 attached to the post 10 attached to the post 10 alternating at each level.
Figure 15B:
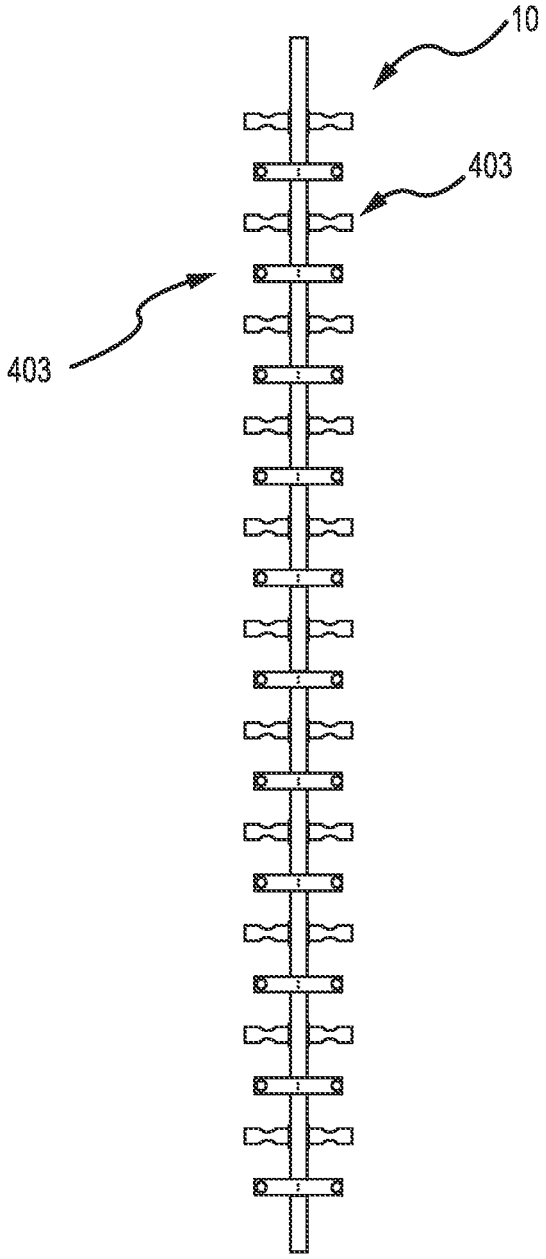
Figure 15C:
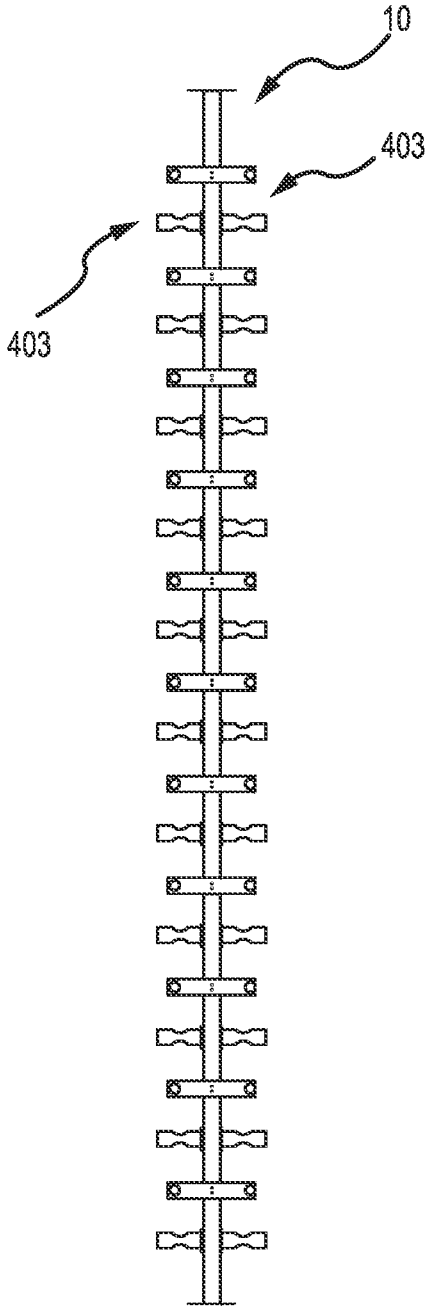
Figure 15D:
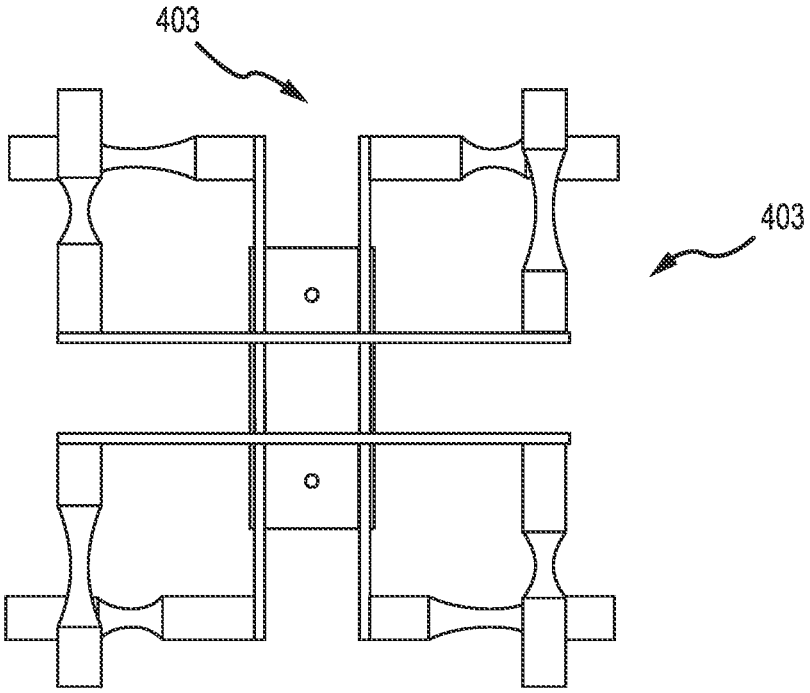
Figure 16A:
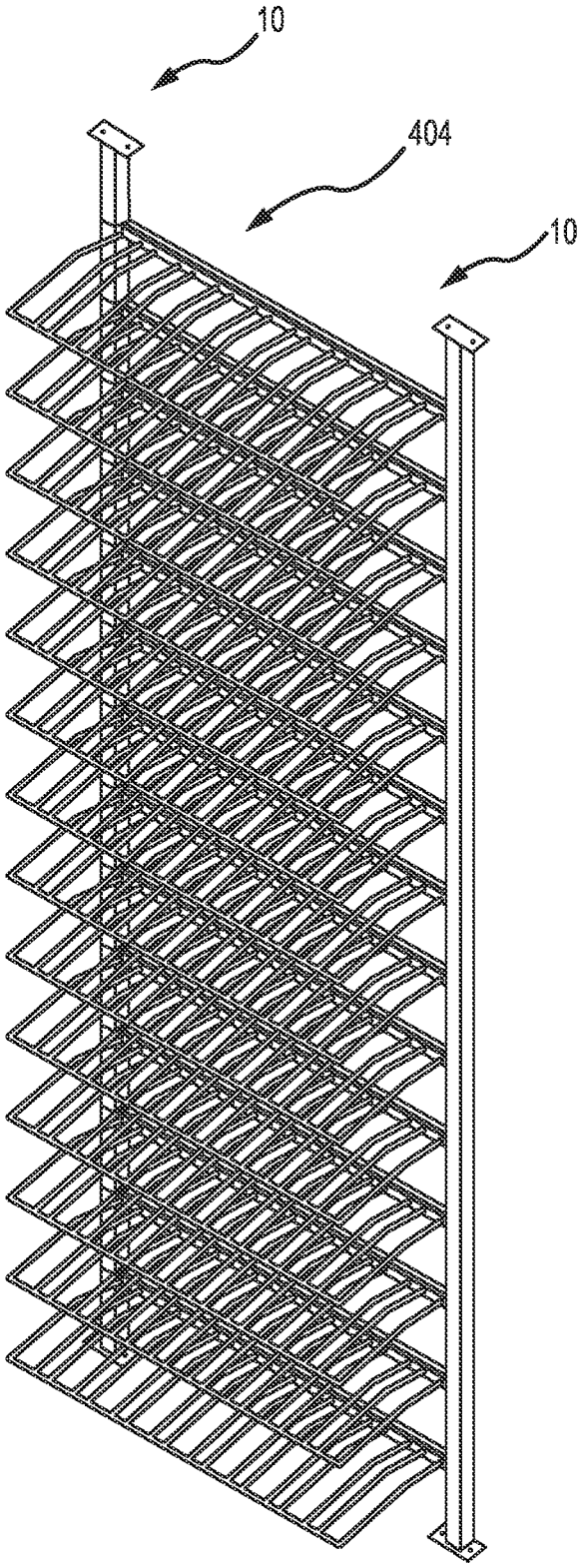
FIGS. 16A-16D show a perspective, front, side and top views of an embodiment of the present invention with the post 10 and wine racks 404 attached to the post 10.
Figure 16B:
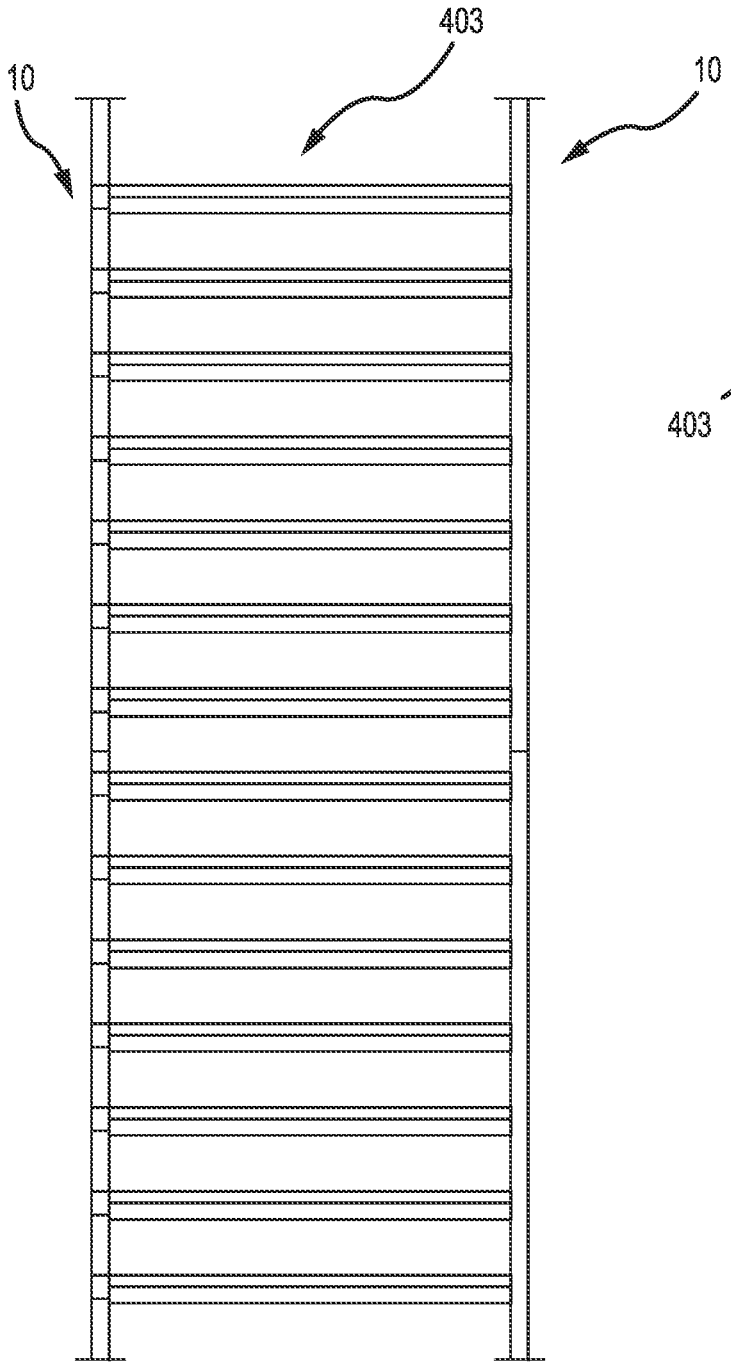
Figure 16C:
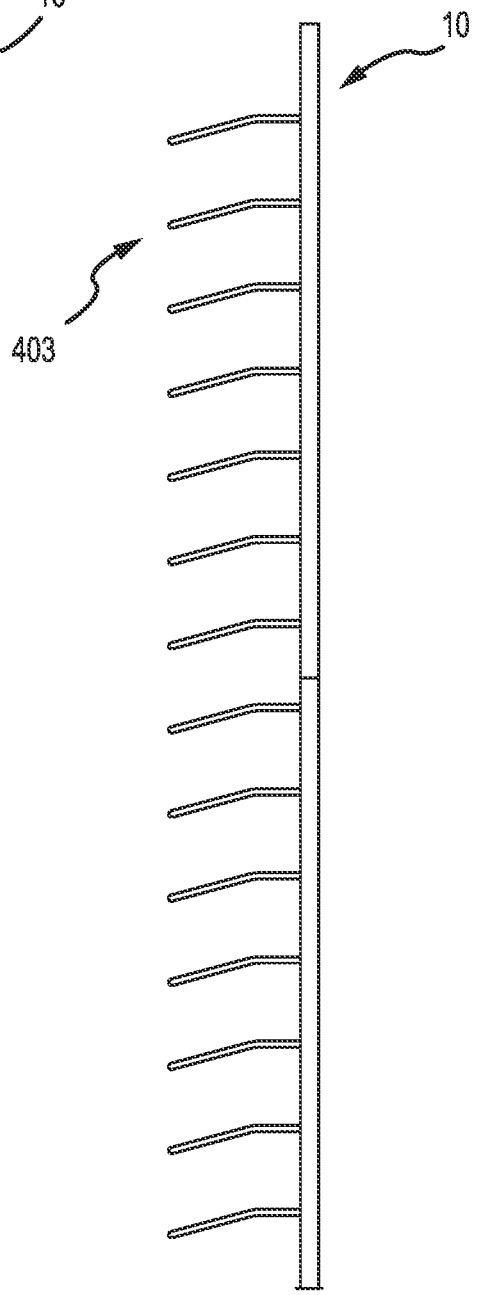
Figure 16D:
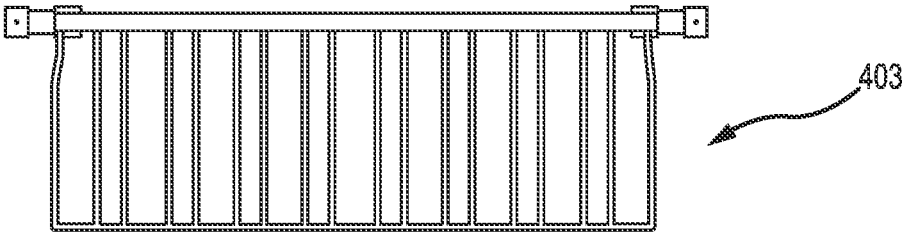
Figure 17A:
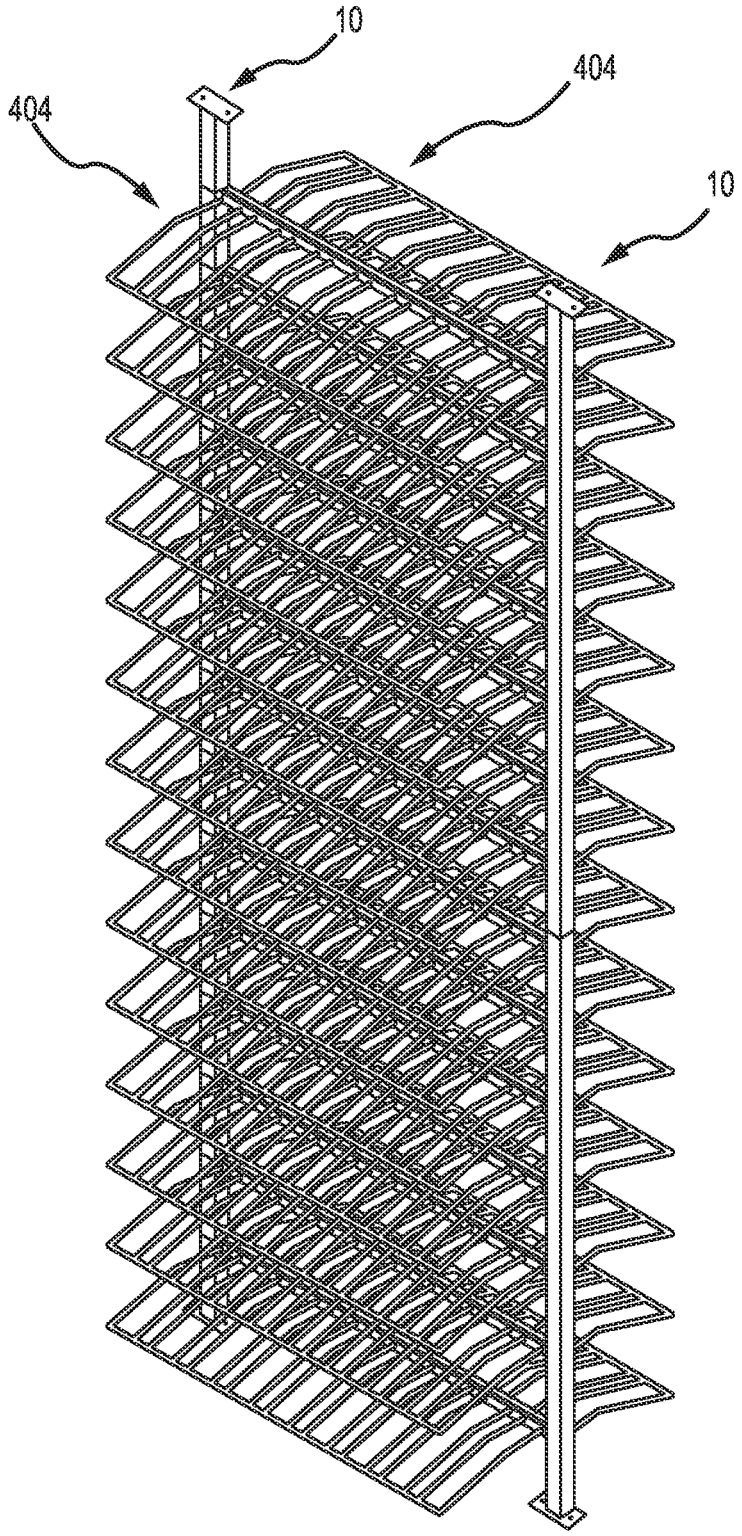
FIGS. 17A-17D show a perspective, front, side and top views of an embodiment of the present invention with the post 10 and wine racks 404 attached to the post 10.
Figure 17B:
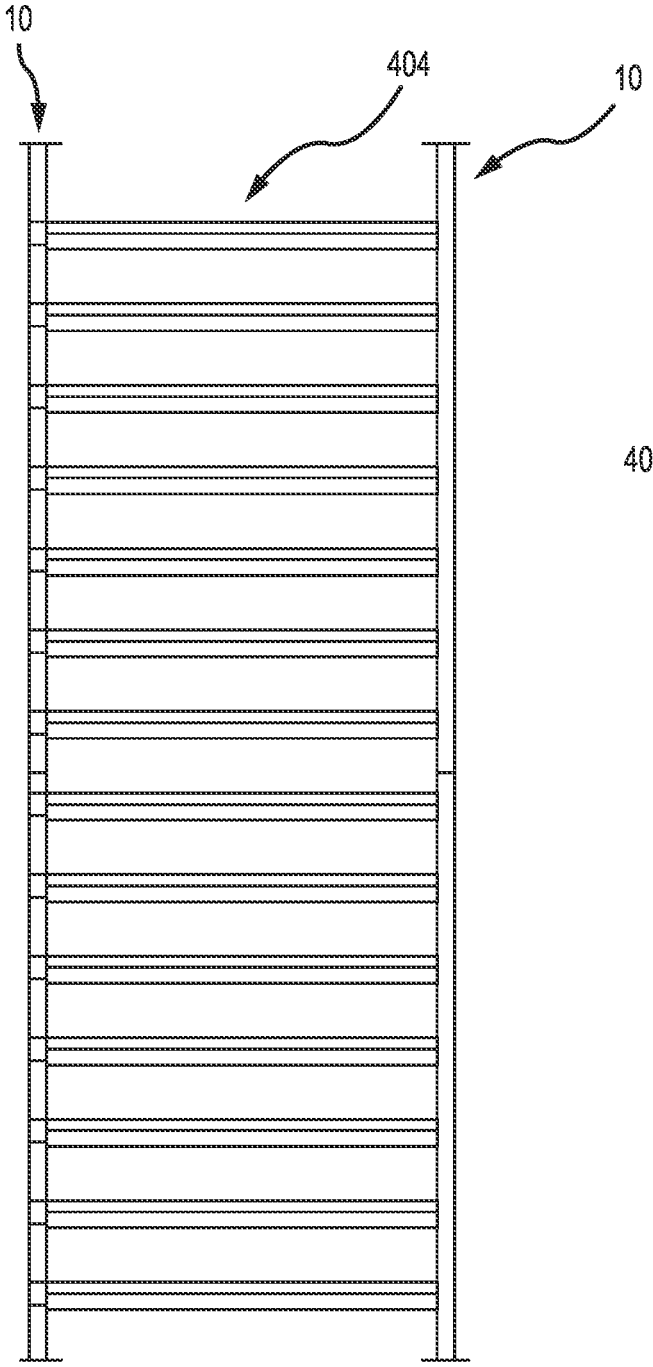
Figure 17C:
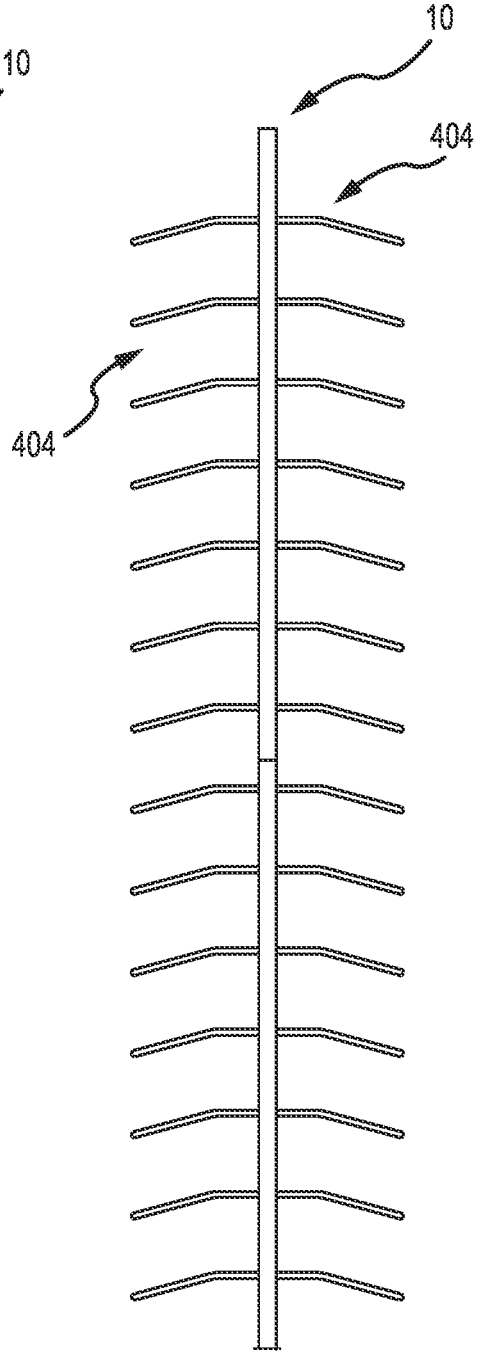
Figure 17D:
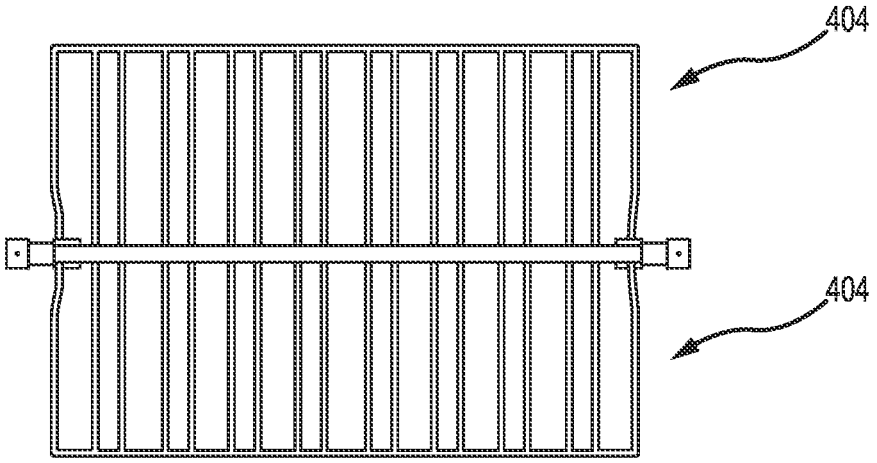

Additionally, the post base 100 and the post top 200 may be secured by attaching wine racks that secure the post top and post base together, as shown, for example, in FIG. 9C. The post of the present invention is installed by standing up the secured post or post/rack combination in the desired location and ensuring that it is plumb both front and back and side-to-side using a level and attaching the mounting plates of the post 10 to the ceiling and floor, as shown in FIG. 9D. Finally, in FIG. 9E, an embodiment is shown wherein the wine rack is attached to the inside wall 18 of the post 10.

With reference to FIGS. 10A-10D, one embodiment of the invention with a post 10 and multiple wine racks 400 shown attached to post 10. In this particular embodiment, the wine rack 400, which is designed to hold the wine bottle "cork forward," is attached to the post 10 on opposite sides of the post 10. It will be appreciated that the wine rack 400 can be attached to the post 10, on one side and opposite sides, and if alternated, on third and fourth (i.e., all sides).

With reference to FIGS. 11A-11D, one embodiment of the invention with a post 10 and multiple wine racks 401 shown attached to post 10. In this particular embodiment, the wine rack 401, which is designed to hold two wine bottles "cork forward," is attached to the post 10 on opposite sides of the post 10. It will be appreciated that the wine rack 401 can be attached to the post 10, on one side and opposite sides, and if alternated, on third and fourth (i.e., all sides).

With reference to FIGS. 12A-12D, one embodiment of the invention with a post 10 and multiple wine racks 402 shown attached to post 10. In this particular embodiment, the wine rack 402, which is designed to hold three wine bottles "cork forward," is attached to the post 10 on opposite sides of the post 10. It will be appreciated that the wine rack 402 can be attached to the post 10, on one side and opposite sides, and if alternated, on third and fourth (i.e., all sides).

With reference to FIGS. 13A-13D, one embodiment of the invention with a post 10 and multiple wine racks 402 shown attached to post 10. In this particular embodiment, the wine rack 402, which is designed to hold three wine bottles "cork forward," is attached to the post 10 on opposite sides of the post 10. Additionally, with particular reference to FIGS. 13B and 13C, each level of the wine rack 402 alternates.

With reference to FIGS. 14A-14D, one embodiment of the invention with a post 10 and multiple wine racks 403 shown attached to post 10. In this particular embodiment, the wine rack 403, which is designed to hold the wine bottle "label forward," is attached to the post 10 on opposite sides of the post 10. It will be appreciated that the wine rack 403 can be attached to the post 10, on one side and opposite sides, and if alternated, on third and fourth (i.e., all sides).

With reference to FIGS. 15A-15D, one embodiment of the invention with a post 10 and multiple wine racks 403 shown attached to post 10. In this particular embodiment, the wine rack 403, which is designed to hold the wine bottle "label forward," is attached to the post 10 on opposite sides of the post 10. Additionally, with particular reference to FIGS. 15B and 15C, each level of the wine rack 403 alternates.

With reference to FIGS. 16A-16D, one embodiment of the invention with two posts 10 and multiple wine racks 404 shown attached to the posts 10. In this particular embodiment, the wine rack 404, which is designed to hold the wine bottle "base forward," is attached to both posts 10.

With reference to FIGS. 17A-17D, one embodiment of the invention with two posts 10 and multiple wine racks 404 shown attached to the posts 10. In this particular embodiment, the wine rack 404, which is designed to hold multiple wine bottles "base forward," is attached to the post 10 on opposite sides of the posts 10.

All directional references used herein (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention.

While the invention has been particularly shown and described with reference to various embodiments thereof, it will be understood by those skilled in the art that various other changes in the form and details may be made without departing from the spirit and scope of the invention.

The invention claimed is:

1. A floor to ceiling wine rack comprising:

a first post comprising a first inner end and a first outer end;

a first base mounting plate configured to couple to the first outer end of the first post;

a second post comprising a second inner end and a second outer end;

a second base mounting plate configured to couple to the second outer end of the second post, wherein the first inner end of the first post and the second inner end of the second post are correspondingly shaped and sized to couple to each other in a way that results in a single seam connection between the first post and the second post; and a plurality of wine racks configured to attach to and extend from the first post and the second post in a cantilevered fashion, wherein one or more of the plurality of wine racks are configured to attach to and secure the first post and the second post together, wherein each of the plurality of wine racks is configured to support one or more wine bottles in at least one of the following orientations: cork forward; base forward; and label forward.

2. The floor to ceiling wine rack of claim 1, wherein each of the first post and the second post have a four-sided cross-section.

3. The floor to ceiling wine rack of claim 2, wherein the four-sided cross-section is square.

4. The floor to ceiling wine rack of claim 1, wherein the first base mounting plate is configured to be secured to a ceiling and the second base mounting plate is configured to be secured to a floor.

5. The floor to ceiling wine rack of claim 1, wherein a length of at least one of the first post and the second post is configured to be cut short at the first inner end or the second inner end, respectively, while still being configured to couple to each other and result in a single seam connection between the first post and the second post.

6. The floor to ceiling wine rack of claim 1, wherein the first post and the second post are of equal lengths.

7. The floor to ceiling wine rack of claim 1, wherein the first post and the second post are of lengths selected from the group: about 3 feet, about 4 feet, about 5 feet or about 6 feet.

8. The floor to ceiling wine rack of claim 1, wherein each of the plurality of wine racks includes a post mounting plate and a pair of tines extending generally parallel to each other and extending outwards from the post mounting plate, the post mounting plate configured to be secured to the first post or the second post, the pair of tines configured to support a body of a wine bottle.

9. The floor to ceiling wine rack of claim 8, wherein a pair of wine racks of the plurality of wine racks are configured to be secured to opposite sides of the first post and the second post.

10. The floor to ceiling wine rack of claim 1, wherein the plurality of wine racks is configured to occupy at least ninety percent of a length of the floor to ceiling wine rack.

* * * * *